US011911683B2

(12) United States Patent
Sorin

(10) Patent No.: US 11,911,683 B2
(45) Date of Patent: Feb. 27, 2024

(54) BLOCK PLATE APPARATUS SYSTEM AND METHODS OF USING SAME

(71) Applicant: Albert Sorin, Lexington, SC (US)

(72) Inventor: Albert Sorin, Lexington, SC (US)

( * ) Notice: Subject to any disclaimer, the term of this patent is extended or adjusted under 35 U.S.C. 154(b) by 0 days.

(21) Appl. No.: 17/577,622

(22) Filed: Jan. 18, 2022

(65) Prior Publication Data

US 2022/0226713 A1 Jul. 21, 2022

Related U.S. Application Data

(60) Provisional application No. 63/138,707, filed on Jan. 18, 2021.

(51) Int. Cl.
*A63B 71/00* (2006.01)
*A63B 21/06* (2006.01)

(52) U.S. Cl.
CPC ..... *A63B 71/0036* (2013.01); *A63B 21/0604* (2013.01)

(58) Field of Classification Search
CPC ..... A63B 21/06–08
See application file for complete search history.

(56) References Cited

U.S. PATENT DOCUMENTS 4,134,584 A * 1/1979 Rosenbusch ..... A63B 21/0618 482/44
4,529,198 A * 7/1985 Hettick, Jr. ..... A63B 21/063 482/107
6,350,221 B1 * 2/2002 Krull ..... A63B 21/4029 482/142
6,974,039 B2 * 12/2005 Comartin ..... A63B 71/0036 482/92
8,834,330 B1 * 9/2014 Morales ..... A63B 21/0605 482/107
9,186,538 B1 * 11/2015 Seen ..... A63B 21/4007
9,498,676 B1 * 11/2016 Emick ..... A63B 23/04
10,456,655 B1 * 10/2019 Orehek ..... B62B 5/06
10,610,726 B2 * 4/2020 Yarvitz ..... A63B 21/4043
11,179,591 B1 * 11/2021 Bazargan ..... A63B 21/0051
2006/0229173 A1 * 10/2006 Foley ..... A63B 21/0605 482/105
2009/0036278 A1 * 2/2009 Towley, III ..... A63B 21/075 482/107
2010/0179033 A1 * 7/2010 Perry ..... A63B 21/072 482/104
2011/0028285 A1 * 2/2011 Towley, III ..... A63B 21/075 482/108
2011/0195823 A1 * 8/2011 Lee ..... A63B 21/0628 482/94
2013/0172160 A1 * 7/2013 Poole ..... A63B 23/0458 482/129
2015/0366384 A1 * 12/2015 Cates ..... A63B 21/06 482/93
2016/0228737 A1 * 8/2016 Rahnasto ..... A63B 23/03525
(Continued)

*Primary Examiner* — Nyca T Nguyen
(74) *Attorney, Agent, or Firm* — Maynard Nexsen PC; Todd Allen Serbin

(57) ABSTRACT

A block plate apparatus system, comprising: at least one block plate; a plurality of stackable blocks, wherein the at least block plate is fastened to the plurality of stackable blocks to form a unified stack. The block plate apparatus system is usable for making exercise more safe and efficient, for example by effectuating the movement of a plurality of stackable blocks as one unit.

15 Claims, 8 Drawing Sheets

(56) References Cited

U.S. PATENT DOCUMENTS

| | | | | |
|---|---|---|---|---|
| 2016/0256730 | A1* | 9/2016 | Bartos | A63B 21/072 |
| 2016/0287932 | A1* | 10/2016 | Brown | A63B 23/0216 |
| 2017/0225025 | A1* | 8/2017 | Towley | A63B 21/075 |
| 2018/0104521 | A1* | 4/2018 | Johnson | A63B 21/072 |
| 2019/0240528 | A1* | 8/2019 | Donnelly | A63B 21/4029 |
| 2020/0101346 | A1* | 4/2020 | Chen | A63B 21/4029 |
| 2021/0023411 | A1* | 1/2021 | Wang | A63B 21/072 |
| 2021/0060374 | A1* | 3/2021 | Slater | A63B 21/4035 |
| 2021/0244994 | A1* | 8/2021 | Wang | A63B 21/4035 |
| 2021/0379440 | A1* | 12/2021 | Sisler | A63B 21/072 |

* cited by examiner

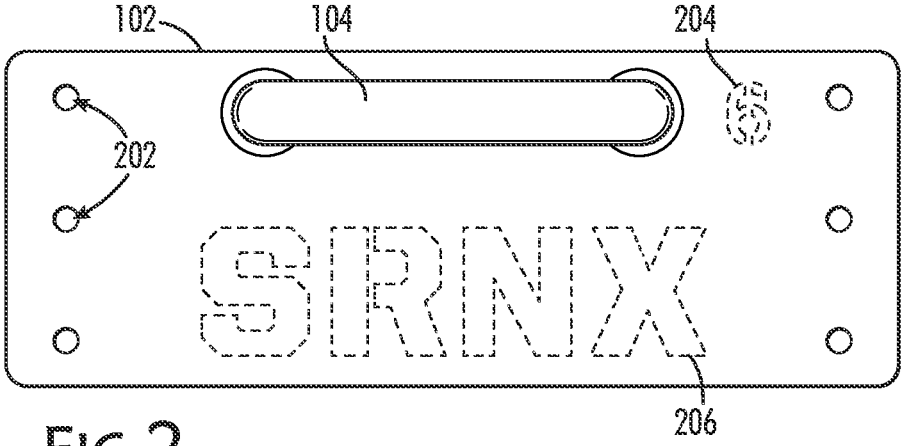
FIG.2
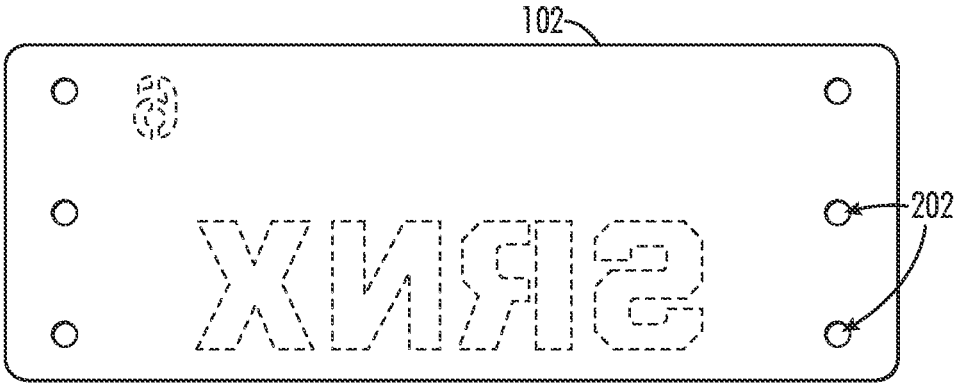
FIG.3
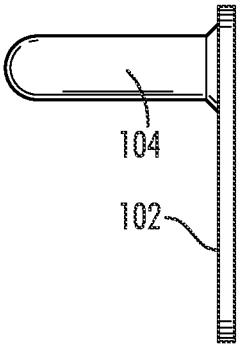
FIG.4
FIG.5
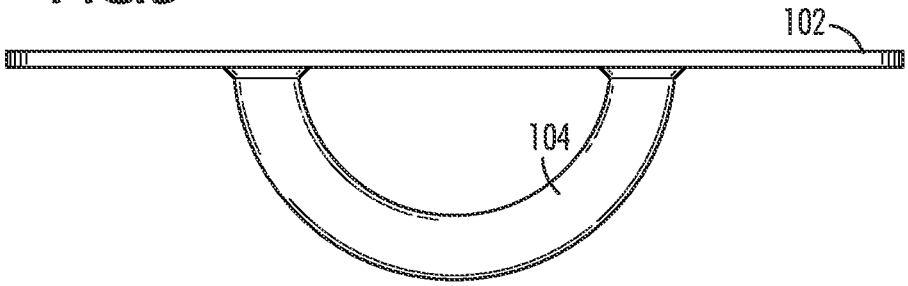

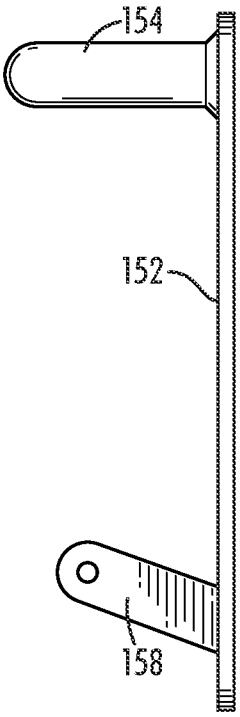
FIG.10
FIG.11
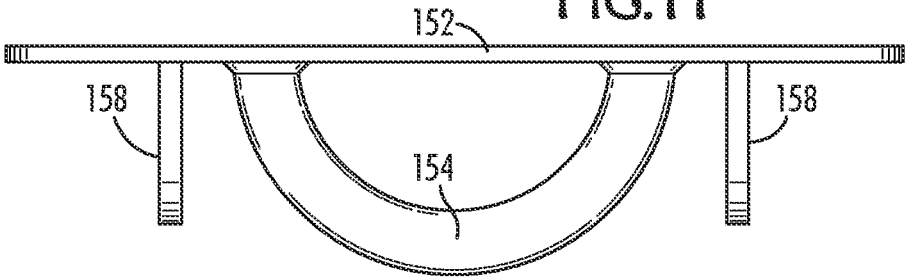

BLOCK PLATE APPARATUS SYSTEM AND METHODS OF USING SAME

RELATED APPLICATIONS

This application claims the benefit of priority under 35 U.S.C. § 119(e) of U.S. Provisional Patent Application No. 63/138,707 filed Jan. 18, 2021, the contents of which are incorporated herein by reference in their entirety.

FIELD OF THE INVENTION

The present invention, in some embodiments thereof, relates to human exercise and, more particularly, but not exclusively, to accessories for making exercise more safe and efficient.

BACKGROUND OF THE INVENTION

Stackable blocks are used in the fitness industry to as tools/accessories for performing exercise thereon. Traditionally, the blocks are modular and thus have to be moved in multiple pieces when transported. Furthermore, the modularity of the stackable blocks only allows for a loose connection between them.

SUMMARY OF THE INVENTION

According to an aspect of some embodiments of the present invention there is provided a block plate apparatus system, comprising: at least one block plate; a plurality of stackable blocks, wherein the at least block plate is fastened to the plurality of stackable blocks to form a unified stack.

In an embodiment of the invention, the system further comprises a plurality of block plates wherein at least one block plate is of a first size and at least one block plate is of a second size.

In an embodiment of the invention, the at least one block plate is provided with at least one wheel attached to the block plate by a wheel mount.

In an embodiment of the invention, the wheel mount is angled.

In an embodiment of the invention, the at least one block plate is indicated with a size indicator.

In an embodiment of the invention, the at least one block plate is provided with at least one aperture for connecting the block plate to one of the plurality of stackable blocks.

In an embodiment of the invention, the at least one block plate is fastened to at least one of the plurality of stackable blocks using a connector.

In an embodiment of the invention, the connector is at least one of a snap, a sliding/interlocking interface, a male/female counterpart-based connector, and/or a hook and pile fastener.

In an embodiment of the invention, the at least one block plate is provided with a handle.

In an embodiment of the invention, the system further comprises a handle forming a component of the at least one block plate and at least one wheel attached to the at least one block plate by a wheel mount.

In an embodiment of the invention, the handle is used with the at least one wheel as a stand when the block plate apparatus system is in a vertical configuration.

In an embodiment of the invention, a distance between the at least one block plate and an end of the handle is the same as a distance between the at least one block plate and a bottom of the at least one wheel.

In an embodiment of the invention, a distance between the at least one block plate and an end of the handle is different from a distance between the at least one block plate and a bottom of the at least one wheel.

According to an aspect of some additional embodiments of the present invention there is further provided a method of using a block plate apparatus system, comprising: placing at least one stackable block on another stackable block to create a stack; attaching at least one block plate including a handle to the stack; and, grabbing the handle to transport the stack.

In an embodiment of the invention, the method further comprises attaching a second block plate to the stack.

In an embodiment of the invention, the method further comprises placing two or more unified stacks on top of each other to create a segmented stack.

In an embodiment of the invention, the method further comprises using at least one wheel provided to the block plate to transport the stack by tipping the stack onto the at least one wheel and then pulling the stack on the at least one wheel from one location to another.

In an embodiment of the invention, the method further comprises using the handle plus the at least one wheel as a stand when the block plate apparatus system is in a vertical orientation.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example, are not necessarily to scale and are for purposes of illustrative discussion of embodiments of the invention. In this regard, the description taken with the drawings makes apparent to those skilled in the art how embodiments of the invention may be practiced.

In the drawings:

FIG. 2 is a front view of a short block plate apparatus, in accordance with an embodiment of the invention;

FIG. 3 is a back view of a short block plate apparatus, in accordance with an embodiment of the invention;

FIG. 4 is a left/right view of a short block plate apparatus, in accordance with an embodiment of the invention;

FIG. 5 is a top/bottom view of a short block plate apparatus, in accordance with an embodiment of the invention;

FIG. 10 is a left/right view of a tall block plate apparatus, in accordance with an embodiment of the invention;

FIG. 11 is a top/bottom view of a tall block plate apparatus, in accordance with an embodiment of the invention;

DESCRIPTION OF SPECIFIC EMBODIMENTS OF THE INVENTION

Figure 1:
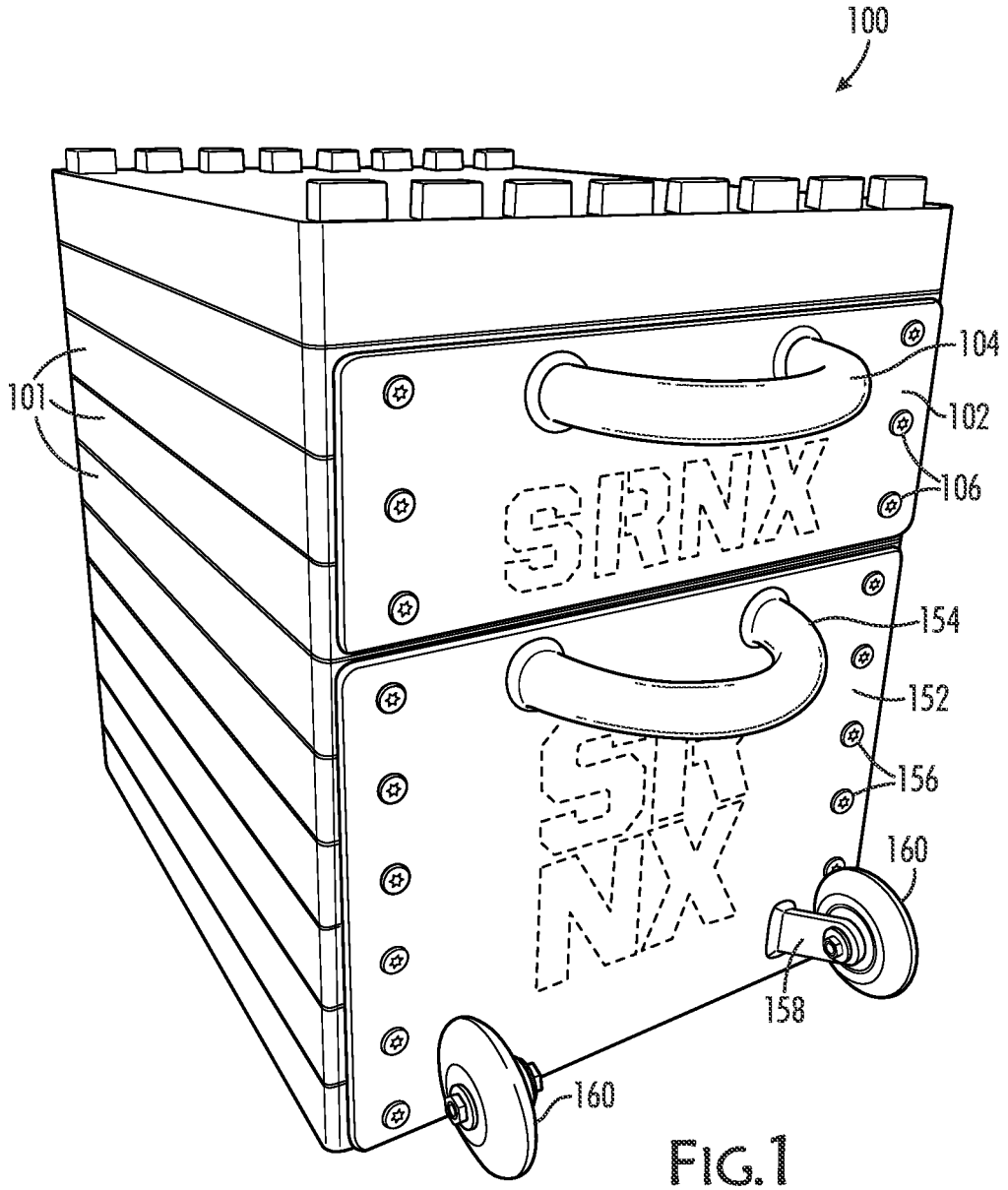
FIG. 1 is a perspective front view of a block plate apparatus system including a short block plate apparatus and tall block plate apparatus being used with stackable blocks, in accordance with an embodiment of the invention.

The present invention, in some embodiments thereof, relates to human exercise and, more particularly, but not exclusively, to accessories for making exercise more safe and efficient.

Before explaining at least one embodiment of the invention in detail, it is to be understood that the invention is not necessarily limited in its application to the details of construction and the arrangement of the components and/or methods set forth in the following description and/or illustrated in the drawings. The invention is capable of other embodiments or of being practiced or carried out in various ways.

Referring now to the drawings, FIG. 1 is a perspective front view of a block plate apparatus system 100, including a short block plate 102 and tall block plate 152 being used with stackable blocks 101, in accordance with an embodiment of the invention. In an embodiment of the invention, it should be understood that block plates 102, 152 are generally used to fasten together a plurality of individual stackable blocks 101, wherein a plurality of blocks can be moved as one and/or are provided with additional stability and/or are provided with enhanced portability and/or enhance exercise efficiency as a result of the plurality of stackable blocks being attached using at least one block plate. Optionally, the stackable blocks are attached to a block plate in a removable/reversible fashion, for example using screws such as shown in more detail with respect to FIGS. 7 and 13. It should also be understood that using screws is just one possible connector that could be used, for example snaps, a sliding/interlocking interface, a male/female counterpart-based connector, and/or hook and pile fasteners could be used.

In some embodiments of the invention, the system 100 only includes a minimum of one of a short block plate 102 or one of a tall block plate 152. However, the use of short and tall block plates can be intermixed depending on how many stackable blocks 101 are desired to be used. For example, one tall block plate and two short block plates could be used. Optionally, "short" and "tall" sizes are not restricted to use with 3 stackable blocks and 6 stackable blocks, respectively, such as shown in the Figures. The Figures are by way of example only and it should be understood that block plates can be used which attach 2 or more stackable blocks together, and in some embodiments, "short" or "tall" can vary in number of blocks attached, even within each category. That is, a "short" block plate which attaches two stackable blocks together could be used with another "short" plate which attaches three or more stackable blocks together. The same variable number concept with respect to sizing applies to the "tall" block plates.

While not shown in the Figures, each stack of stackable blocks unified by a block plate could have a block plate on each side of the stack, in some embodiments of the invention. For example in FIG. 1, there would be mirror image short and tall block plates on the rear of the stack shown so that each stack could be grabbed from either side.

In an embodiment of the invention, each block plate 102, 152 is provided with a handle 104, 154, respectively. Screws 106, 156 are shown affixing the block plates 102, 152 to the stackable blocks 101, in the depicted embodiment, however, other connectors could be used as described elsewhere herein. In some embodiments of the invention, not every stackable block in a stack is affixed to the block plate, for example maybe only the top and bottom stackable blocks in a unified stack are affixed to the block plate. Optionally, only the bottom block is affixed to the block plate.

In some embodiments of the invention, a block plate is provided with wheel mounts 158 to mount wheels 160 thereon, which enhances the transportability of a stack of stackable blocks. In an embodiment of the invention, the wheel mounts 158 are angled, for example to "raise" the wheels 160 off of the ground when the system 100 is in a horizontal orientation and/or deployed for use. While the wheels 160 are shown being used with a tall block plate, wheel mounts and wheels could be provided to a short block plate.

FIG. 2 is a front view of a short block plate apparatus 102 showing the handle 104 and apertures 202 for inserting the screws 106 therethrough. Also shown are a height indicator 204, which would vary depending on how many stackable blocks were unified by the block plate apparatus, and an optional brand or text message 206. FIG. 3 is a back view of a short block plate apparatus 102.

FIG. 4 is a left/right view of a short block plate apparatus 102. FIG. 5 is a top/bottom view of a short block plate apparatus 102.

Figure 6:
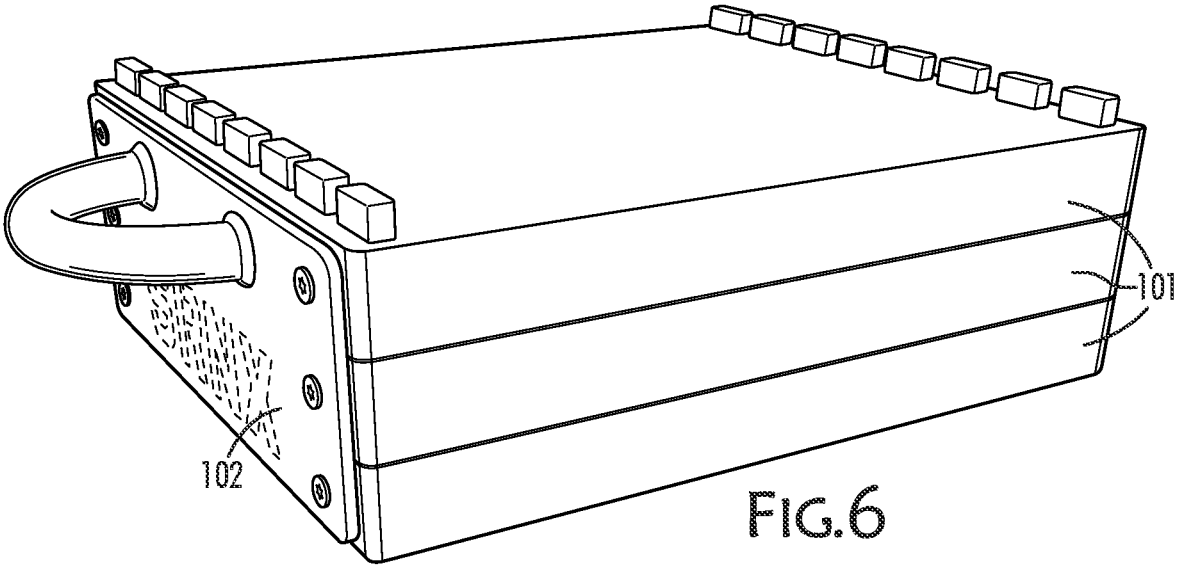
FIG. 6 is a perspective view of a short block plate apparatus being used with stackable blocks, in accordance with an embodiment of the invention.

FIG. 6 is a perspective view of a short block plate apparatus 102 being used with stackable blocks 101, in accordance with an embodiment of the invention. In an embodiment of the invention, a "short" and unitary stack of stackable blocks is created by attaching at least one short block plate apparatus 102 to the stackable blocks 101, with optionally, another short block plate apparatus 102 (not shown) attached on the opposite side of the stack.

Figure 7:
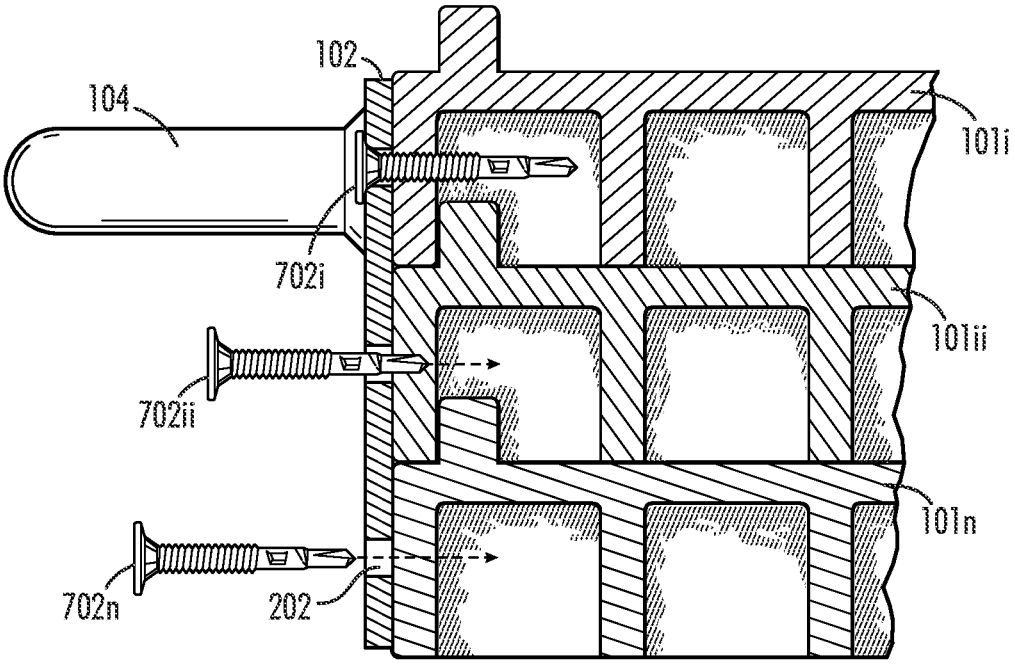
FIG. 7 is a cross-sectional view showing a short block plate apparatus securing to stackable blocks, in accordance with an embodiment of the invention.

FIG. 7 is a cross-sectional view showing a short block plate apparatus 102 securing to stackable blocks 101*i*, 1014, 101*n* (where n is the total number of blocks in the stack), in accordance with an embodiment of the invention. As can be seen, screws 702*i*, 702*ii*, 702*n* are used to removably fasten each of stackable blocks 101*i*, 101*ii*, 101*n*, respectively, to block plate 102 through the apertures 202, thereby creating a unified stack which is more stable and more easily transportable.

Figure 8:
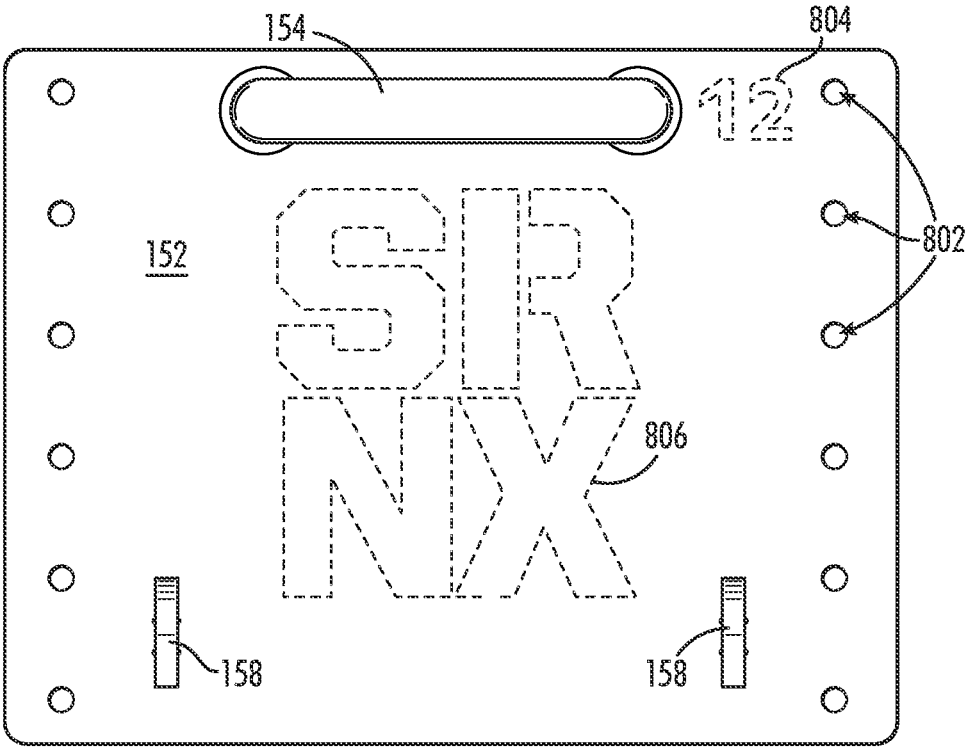
FIG. 8 is a front view of a tall block plate apparatus, in accordance with an embodiment of the invention.
Figure 9:
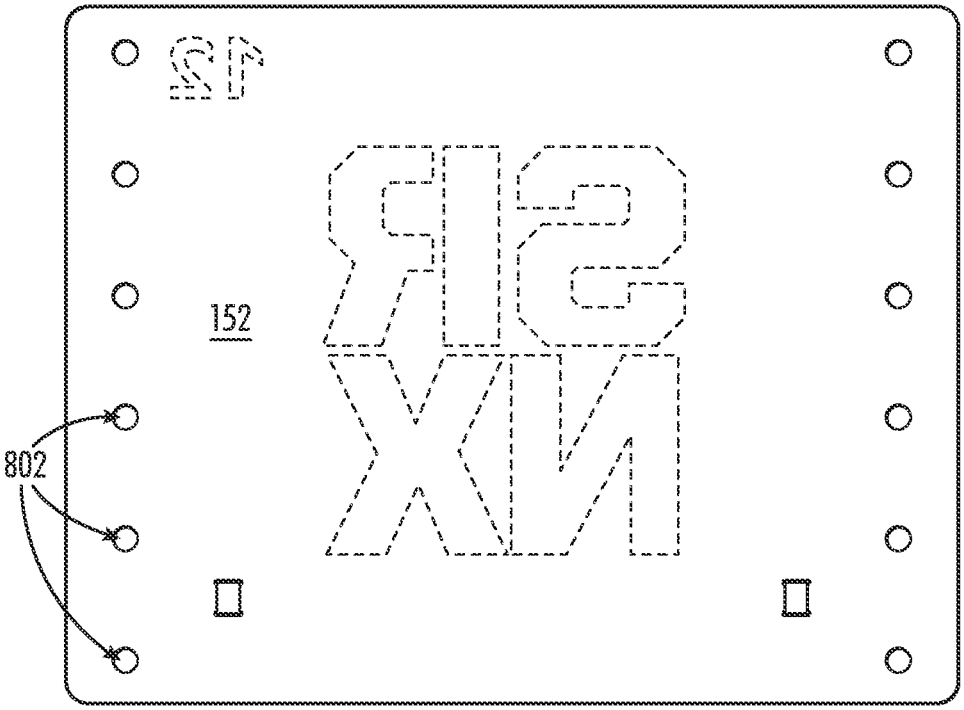
FIG. 9 is a back view of a tall block plate apparatus, in accordance with an embodiment of the invention.

FIG. 8 is a front view of a tall block plate apparatus 152, in accordance with an embodiment of the invention. FIG. 2 shows the handle 154 and apertures 802 for inserting the screws 156 therethrough. Also shown are a height indicator 804, which would vary depending on how many stackable blocks were unified by the block plate apparatus, and an optional brand or text message 806. Wheel mounts 158 are optionally provided to the face of the block plate apparatus 152 for fastening wheels (not shown) thereto. FIG. 9 is a back view of a tall block plate apparatus 152, in accordance with an embodiment of the invention.

FIG. 10 is a left/right view of a tall block plate apparatus 152, showing the wheel mount 158 in more detail, in accordance with an embodiment of the invention. FIG. 11 is a top/bottom view of a tall block plate apparatus 152, in accordance with an embodiment of the invention.

Figure 12:
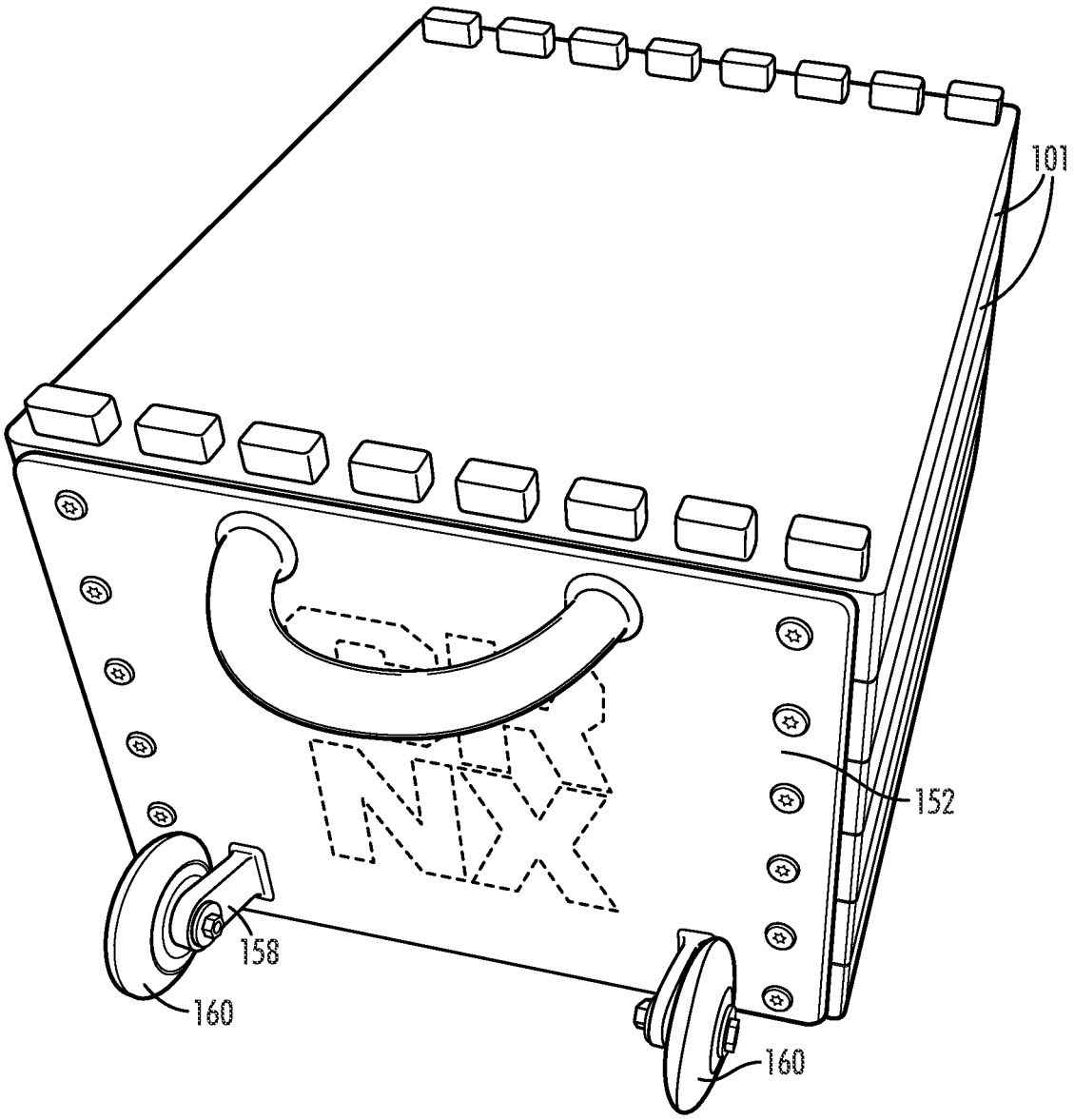
FIG. 12 is a perspective front view of a tall block plate apparatus being used with stackable blocks, in accordance with an embodiment of the invention.

FIG. 12 is a perspective front view of a tall block plate apparatus 152 being used with stackable blocks 101, in accordance with an embodiment of the invention. In an embodiment of the invention, a "tall" and unitary stack of stackable blocks is created by attaching at least one tall block plate apparatus 152 to the stackable blocks 101, with optionally, another tall block plate apparatus 152 (not shown) attached on the opposite side of the stack. In use, when wheels 160 are used with the block plate 152, the handle on the opposite side block plate is used to pull the stack, utilizing the length of the stack as a lever and the wheels 160 as a pivot point for lifting the weight of the stack to facilitate movement of the stack from one location to another. In some embodiments of the invention, no matter how many block plates are used, short or tall, only the bottom block plate has wheels.

Figure 13:
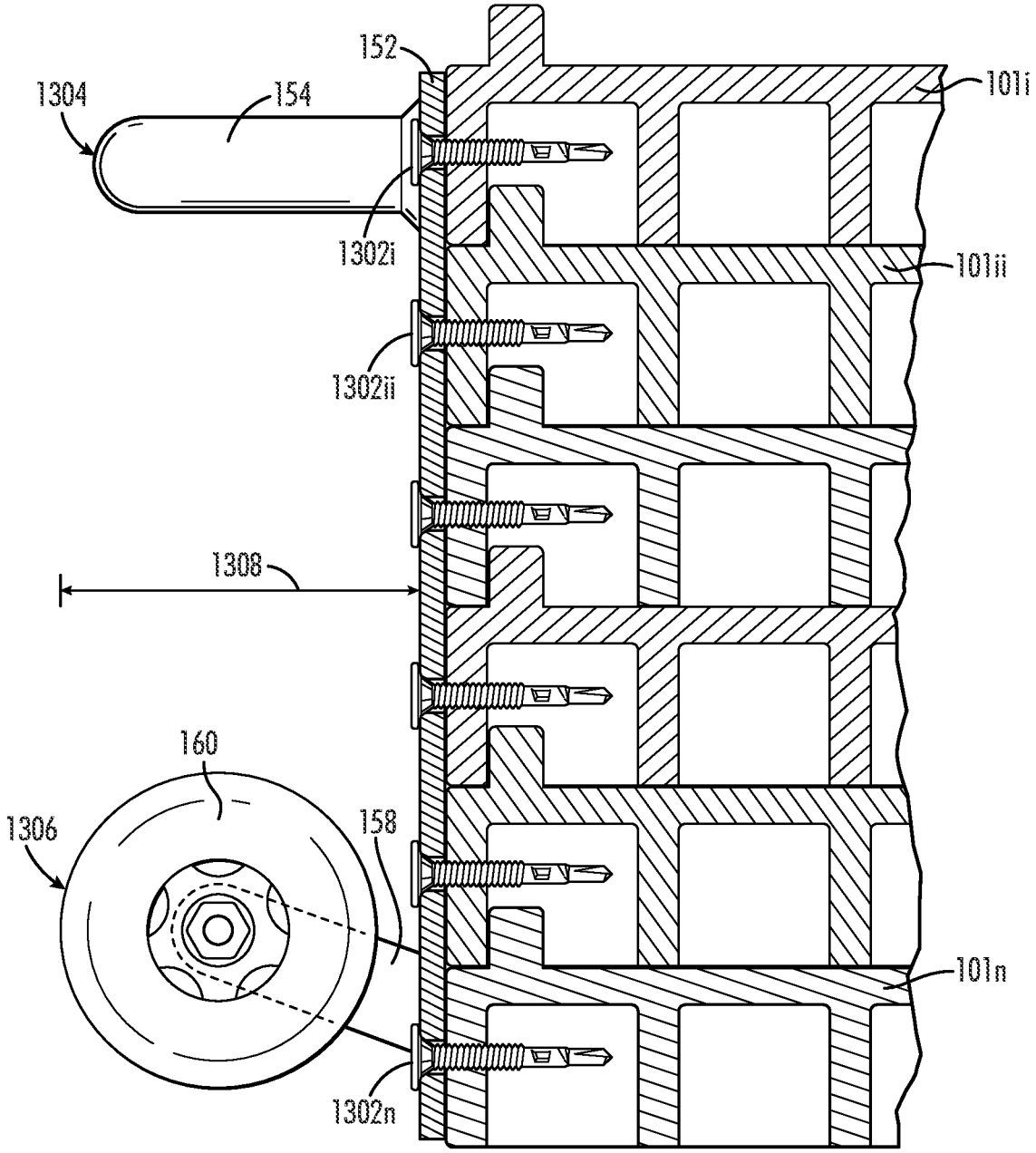
FIG. 13 is a cross-sectional view showing a tall block plate apparatus securing to stackable blocks, in accordance with an embodiment of the invention; and, FIG. 14 is flowchart of a method of using a block plate apparatus, in accordance with an embodiment of the invention.

FIG. 13 is a cross-sectional view showing a tall block plate apparatus 152 securing to stackable blocks 101, in accordance with an embodiment of the invention. Similar to FIG. 7. FIG. 13 is a cross-sectional view showing a tall block plate apparatus 152 secured to stackable blocks 101*i*, 101*ii*, 101*n*, in accordance with an embodiment of the invention. As can be seen, screws 3302*i*, 1302*ii*, 1302*n* are used to removably, fasten each of stackable blocks 101*i*, 101*ii*, 101*n*, respectively, to block plate 152 through the apertures 802, thereby creating a unified stack which is more stable and more easily transportable.

In some embodiments of the invention, the handle 154 is used as a stand, for example in combination with the wheels 160, when the system 100 is in a vertical configuration where the major axis of the stackable blocks 101 is in a vertical orientation instead of horizontal, a horizontal orientation being shown in FIG. 1. Optionally, the handle 154 and the wheels 160 are configured to have respective height dimensions which position the stackable blocks 101 at 90 degree, or nearly 90 degree, orientation with respect to the ground when the stackable blocks 101 are in the vertical orientation. That is, the distance 1308 from an end 1304 of the handle 154 to the block plate apparatus 152 and the bottom 1306 of the wheels 160 to the block plate apparatus 152, including the wheel mounts 158, is the same. Optionally, these distances are different for the handle 154 and the at least one wheel 160, for example, to position the system 100 in an off-vertical orientation when in the "vertical" configuration.

Figure 14:
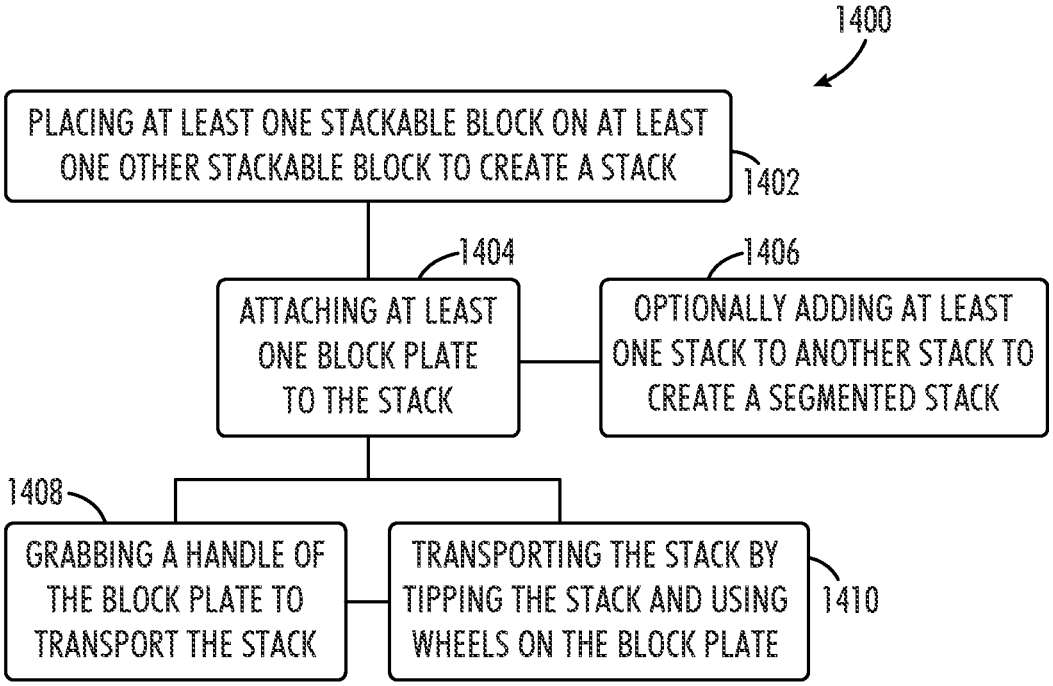

FIG. 14 is flowchart 1400 of a method of using a block plate apparatus system 100, in accordance with an embodiment of the invention. In an embodiment of the invention, a stack of a plurality of stackable blocks 101 is created by placing (1402) at least one stackable block 101 on another. This stack is unified by attaching (1404) at least one block plate 102, 152 to the stack. Optionally, one block plate is attached to one side of the stack and a second block plate is attached to an opposite side of the stack. In some embodiments, the second block plate could be attached to a side of the stack, perpendicular to the first block plate. Optionally, more than two block plates are used, for example, one for each side of the stack.

In some embodiments of the invention, a segmented stack, such as shown in FIG. 1, is made (1406) by placing two or more unified stacks on top of each other. For example, by placing a short unified stack (which uses block plate 102) on top of a tall unified stack (which uses block late 152).

In some embodiments of the invention, a unified or segmented stack is transported by grabbing (1408) the handles. Alternatively, additionally, and/or optionally, a unified or segmented stack is transported (1410) by tipping up the stack onto wheels 160, and then is pulled on the wheels from one location to another.

Optionally, the stack can be placed in a vertical orientation by using at least one of a handle and a wheel as a stand.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

The term "plurality" means "two or more".

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all to such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A block plate apparatus system, comprising:

at least one block plate comprising a handle and at least one wheel attached to the at least one block plate by a wheel mount;

a plurality of stackable blocks, wherein the at least one block plate is fastened to the plurality of stackable blocks to form a unified vertical stack, wherein the handle is positioned vertically above the at least one wheel to create a lever arm from the unified vertical stack which is rotatable around an axis defined by the at least one wheel.

2. The block plate apparatus system according to claim 1, further comprising a plurality of block plates wherein at least one block plate is of a first size and at least one block plate is of a second size.

3. The block plate apparatus system according to claim 1, wherein the wheel mount is angled.

4. The block plate apparatus system according to claim 1, wherein the at least one block plate is indicated with a size indicator.

5. The block plate apparatus system according to claim 1, wherein the at least one block plate is provided with at least one aperture for connecting the block plate to one of the plurality of stackable blocks.

6. The block plate apparatus system according to claim 1, wherein the at least one block plate is fastened to at least one of the plurality of stackable blocks using a connector.

7. The block plate apparatus system according to claim 6, wherein the connector is at least one of a snap, a sliding/interlocking interface, a male/female counterpart-based connector, and/or a hook and pile fastener.

8. The block plate apparatus system according to claim 1, wherein the handle is used with the at least one wheel as a stand when the block plate apparatus system is in a vertical configuration.

9. The block plate apparatus system according to claim 1, wherein a distance between the at least one block plate and an end of the handle is the same as a distance between the at least one block plate and a bottom of the at least one wheel.

10. The block plate apparatus system according to claim 1, wherein a distance between the at least one block plate and an end of the handle is different from a distance between the at least one block plate and a bottom of the at least one wheel.

11. A method of using a block plate apparatus system, comprising:

placing at least one stackable block on another stackable block to create a vertical stack;

attaching at least one block plate, including a handle and at least one wheel attached to the at least one block plate by a wheel mount, to the vertical stack to create a unified vertical stack forming a lever arm; and, grabbing the handle to transport the unified vertical stack.

12. The method according to claim 11, further comprising attaching a second block plate to the stack.

13. The method according to claim 11, further comprising placing two or more unified stacks on top of each other to create a segmented stack.

14. The method of using a block plate apparatus system according to claim 11, further comprising transporting the stack by tipping the unified vertical stack onto the at least one wheel and then pulling the unified vertical stack on the at least one wheel from one location to another.

15. The method according to claim 14, further comprising using the handle plus the at least one wheel as a stand when the block plate apparatus system is in a vertical orientation.

* * * * *